US005274611A

United States Patent [19]

Donohoe

[11] Patent Number: 5,274,611

[45] Date of Patent: Dec. 28, 1993

[54] APPARATUS AND METHOD FOR ESTIMATING THE EXPIRED PORTION OF THE EXPECTED TOTAL SERVICE LIFE OF A MERCURY VAPOR LAMP BASED UPON THE TIME THE LAMP IS ELECTRICALLY ENERGIZED

[76] Inventor: Joseph Donohoe, 540 Powderhorn Rd., King of Prussia, Pa. 19406

[21] Appl. No.: 872,193

[22] Filed: Apr. 22, 1992

[51] Int. Cl.[5] ..... G04B 37/00; G04F 8/00

[52] U.S. Cl. ..... 368/10; 368/9

[58] Field of Search ..... 368/1, 9, 10; 250/205

[56] References Cited

U.S. PATENT DOCUMENTS

| | | | |
|---|---|---|---|
| 1,981,860 | 11/1934 | Gebhart et al. | 368/9 |
| 2,551,179 | 5/1951 | Spencer | 161/15 |
| 4,097,783 | 6/1978 | Hathaway | 315/323 |
| 4,707,796 | 11/1987 | Calabro | 364/552 |
| 4,760,250 | 7/1988 | Loeppert | 250/227 |
| 4,810,936 | 3/1989 | Nuckolls et al. | 315/119 |
| 4,831,564 | 5/1989 | Suga | 364/551.01 |
| 4,920,549 | 4/1990 | Dinovo | 377/16 |
| 4,956,825 | 9/1990 | Wilts et al. | 368/9 |

*Primary Examiner*—Bernard Roskoski

*Attorney, Agent, or Firm*—Panitch, Schwarze Jacobs & Nadel

[57] ABSTRACT

A method and apparatus for estimating the expired portion of the expected total service life of a mercury vapor lamp based upon the time that the lamp is electrically energized. The length of time that the lamp is energized is measured for each time period that the lamp is energized throughout the life of the lamp. A lamp usage value is determined for each time period that the lamp is energized. The lamp usage value for each time period is determined by assigning a first time dependent value for each time unit of a first predetermined time segment of the time period that the lamp is energized. A second time dependent value is assigned for each time unit of a second predetermined time segment of the time period commencing after the expiration of the first time segment that the lamp is energized. A third time dependent value is assigned for each time unit of the time period that the lamp is energized beyond the expiration of the second time segment. The first, second and third time dependent values are combined to form the lamp usage value for each time period. The lamp usage values are accumulated for each time period the lamp is energized to provide a total of the lamp life usage value. The total lamp life usage value is displayed as an indication of the expired life of the lamp.

26 Claims, 10 Drawing Sheets

LCD
LTD228R
52
50
53
54
57
59
61
U13C
74HC02
U2B
74HC11
U11A
74HC27
U10
74HC4040
U12A
74HC380
U2A
74HC04
R1
5.1K
R3
R4
5.1K
R27
20K
S1
CLEAR
S1
SM SPDT
VCC
BATT
DP
BPA
BPB
BPC
CLK
RST
CKA
CKB
CLR
QA
QB
QC
QD

APPARATUS AND METHOD FOR ESTIMATING THE EXPIRED PORTION OF THE EXPECTED TOTAL SERVICE LIFE OF A MERCURY VAPOR LAMP BASED UPON THE TIME THE LAMP IS ELECTRICALLY ENERGIZED

BACKGROUND OF THE INVENTION

The present invention is directed to an apparatus and method for estimating the expired portion of the expected total service life of a mercury vapor lamp, and more particularly, to an apparatus and method for estimating the expired portion of the expected total service life of a mercury vapor lamp based upon the time the lamp is electrically energized.

Many fluorescence microscopes use mercury vapor lamps for conducting various medical and scientific tests involving the use of fluorescent dyes. Mercury vapor lamps radiate intense ultraviolet radiation and have extremely high luminance in the visible spectral range. A sample to be tested is placed on a microscope stage and irradiated with an ultraviolet light source, such as a mercury vapor lamp. Ultraviolet light has a wavelength which falls in the range of 280 to 400 nm. If the sample has absorbed the fluorescent dye, the ultraviolet source excites the molecules in the dye and a longer wavelength is fluoresced off. The longer wavelength can be seen by the human eye and indicates that the sample has tested positive.

The average service life for a mercury vapor lamp is approximately 100 or 200 hours depending upon the type of lamp used. However, short-term uses of the lamp, i.e., less than two hours, can result in a shorter overall service life of the lamp. This is due to the high voltage initially required cause an arc discharge in the surrounding gas and creates the heat necessary required to vaporize the mercury in the lamp. Many problems can occur if the mercury vapor lamp is not changed prior to the termination of its service life. As the lamp reaches the end of its service life, the ultraviolet radiation drops off, but the lamp still gives off bright white light which leads unwary users to assume that the lamp is still good. Furthermore, when the lamp completely burns out it tends to explode, dispersing quartz particles and mercury vapor around the microscope and work area potentially causing damage to the microscope and injury to a user or other persons in the vicinity. In addition, the work area must be immediately evacuated and then thoroughly cleaned resulting in significant down time for the microscope.

There is a need for an apparatus or method which is capable of accurately determining when the expected service life for a lamp, particularly a mercury vapor lamp, is approaching or has reached expiration. The apparatus should include a display that can be reset when a new lamp is installed. The apparatus should keep a running total of whenever the lamp is switched on and maintain the elapsed time in memory between uses independent of the presence of power. The apparatus should also be able to proportionally determine and account for initial uses of the lamp, i.e., when the lamp is first turned on, and prolonged uses, i.e., over a significant period of time, and should take into account the shortened lamp life caused by short-term use.

SUMMARY OF THE INVENTION

Briefly stated, the present invention is directed to an apparatus and method for estimating the expired portion of the expected total service life of a mercury vapor lamp based upon the time that the lamp is electrically energized. Means are provided for measuring the length of time that the lamp is energized for each time period that the lamp is energized throughout the service life of the lamp. Means are also provided for determining a lamp usage value for each time period that the lamp is energized. The lamp usage value for each such time period is determined by assigning a first time dependent value for each time unit of a first predetermined time segment of the time period that the lamp is energized. A second time dependent value is assigned for each time unit of a second predetermined time segment of the time period commencing after the expiration of the first time segment that the lamp is energized. A third time dependent value for each time unit of the time period that the lamp is energized beyond the expiration of the second time segment is also assigned. The first, second and third time dependent values are combined to form the lamp usage value for each time period. Means for accumulating the lamp usage value for each time period the lamp is energized are employed to provide a total of the lamp service life usage value, and means are provided for displaying the total lamp service life usage value as an indication of the expired service life of the lamp.

BRIEF DESCRIPTION OF THE DRAWINGS

The foregoing summary, as well as the following detailed description of a preferred embodiment, will be better understood when read in conjunction with the appended drawings. For the purpose of illustrating the invention, there is shown in the drawings an embodiment which is presently preferred, it being understood, however, that the invention is not limited to the specific methods and instrumentalities disclosed. In the drawings.

DESCRIPTION OF THE PREFERRED EMBODIMENT

Figure 1:
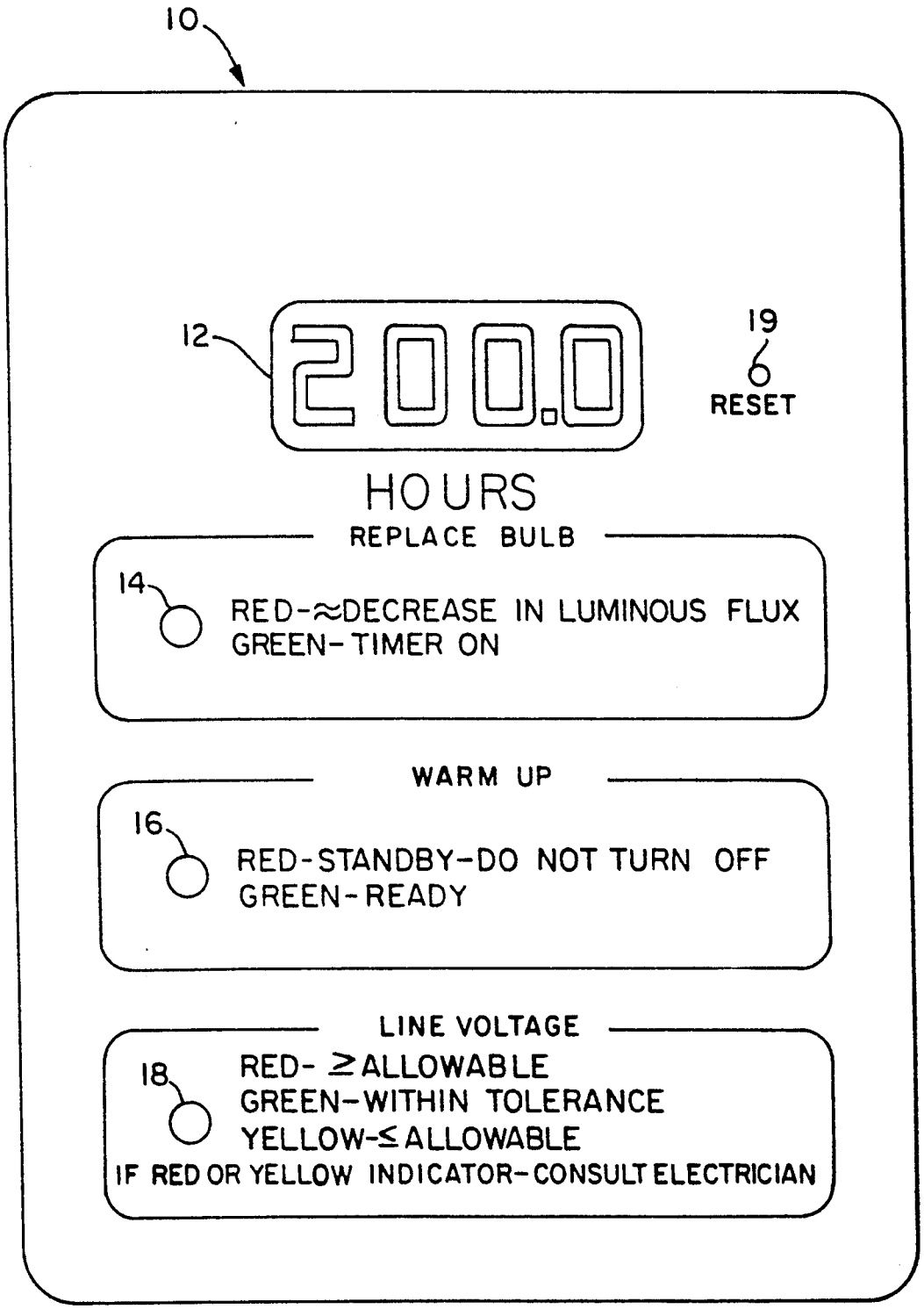
FIG. 1 is a front elevational view of a front panel of a service life timer in accordance with the present invention.
Figure 2A:
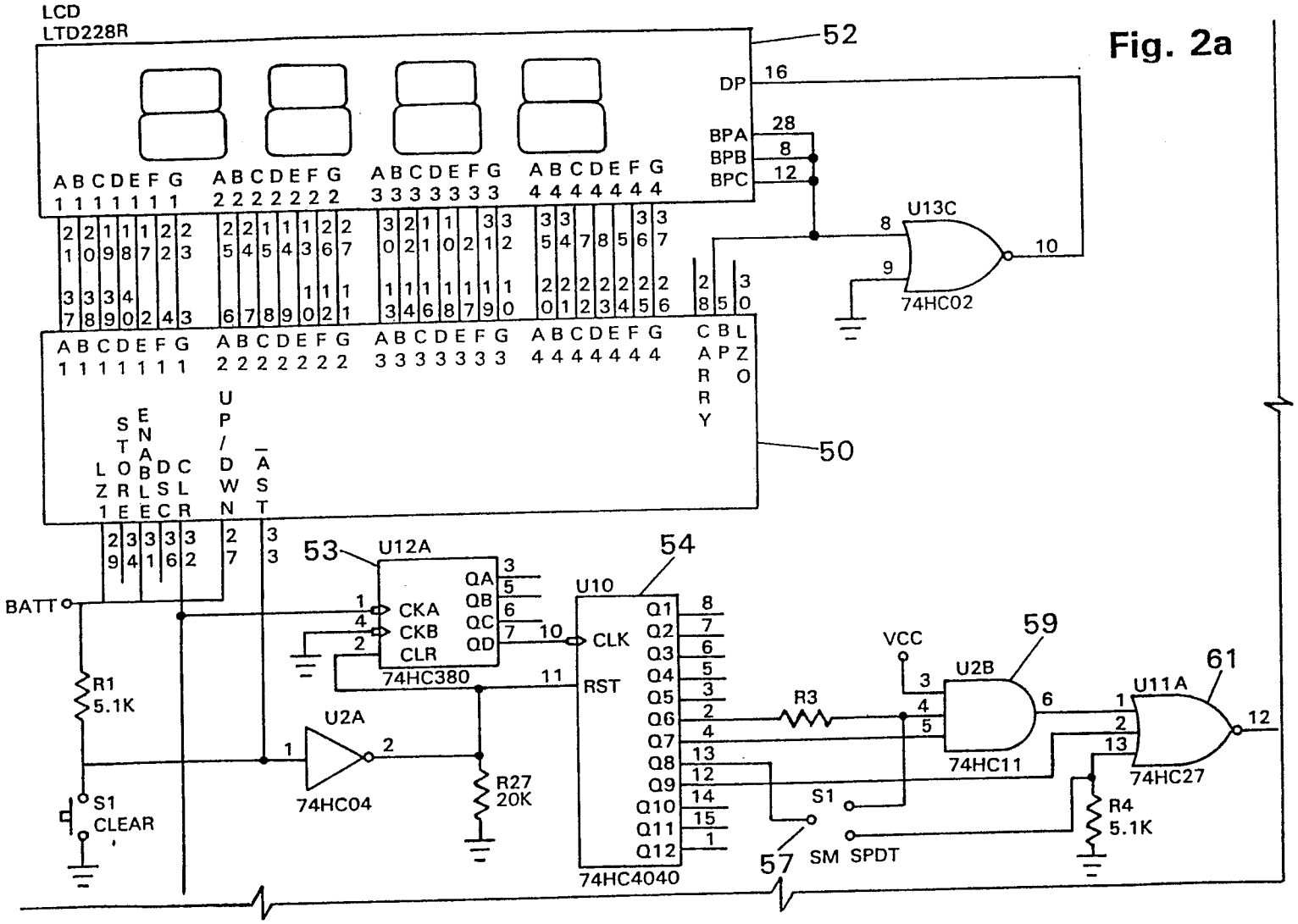
FIG. 2 is a detailed schematic of the circuitry of the service life timer of FIG. 1.
Figure 2B:
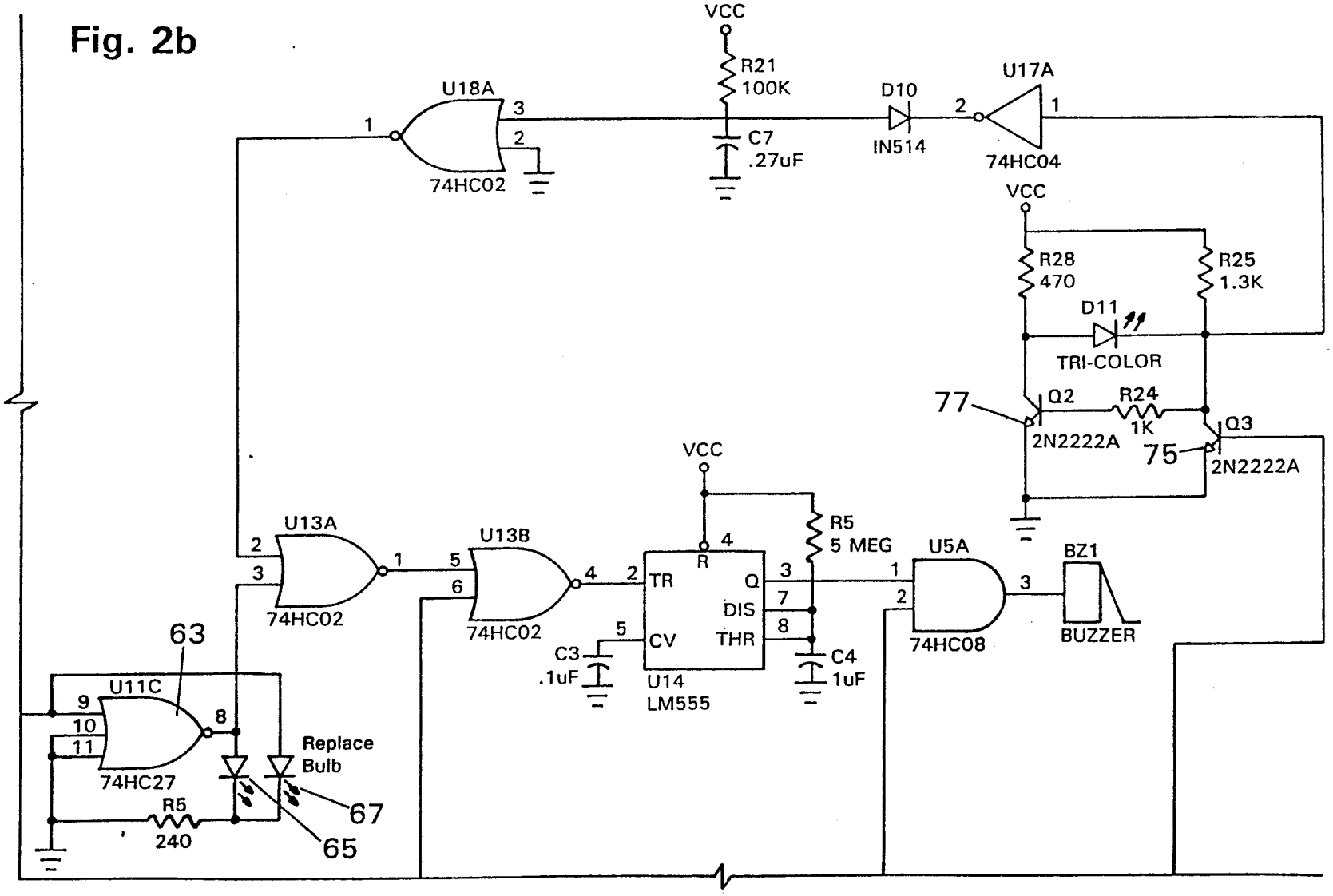
Figure 2C:
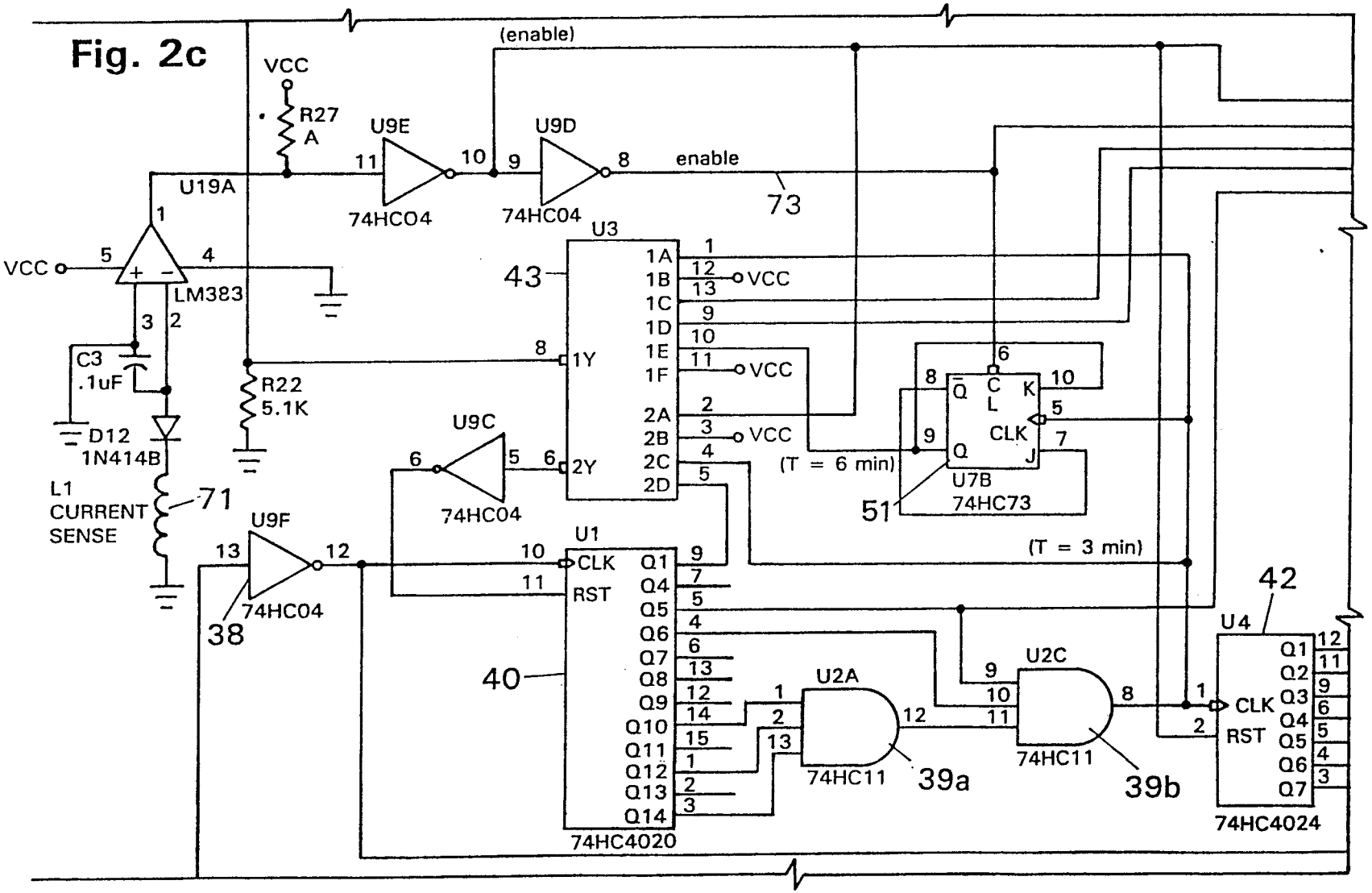
Figure 2D:
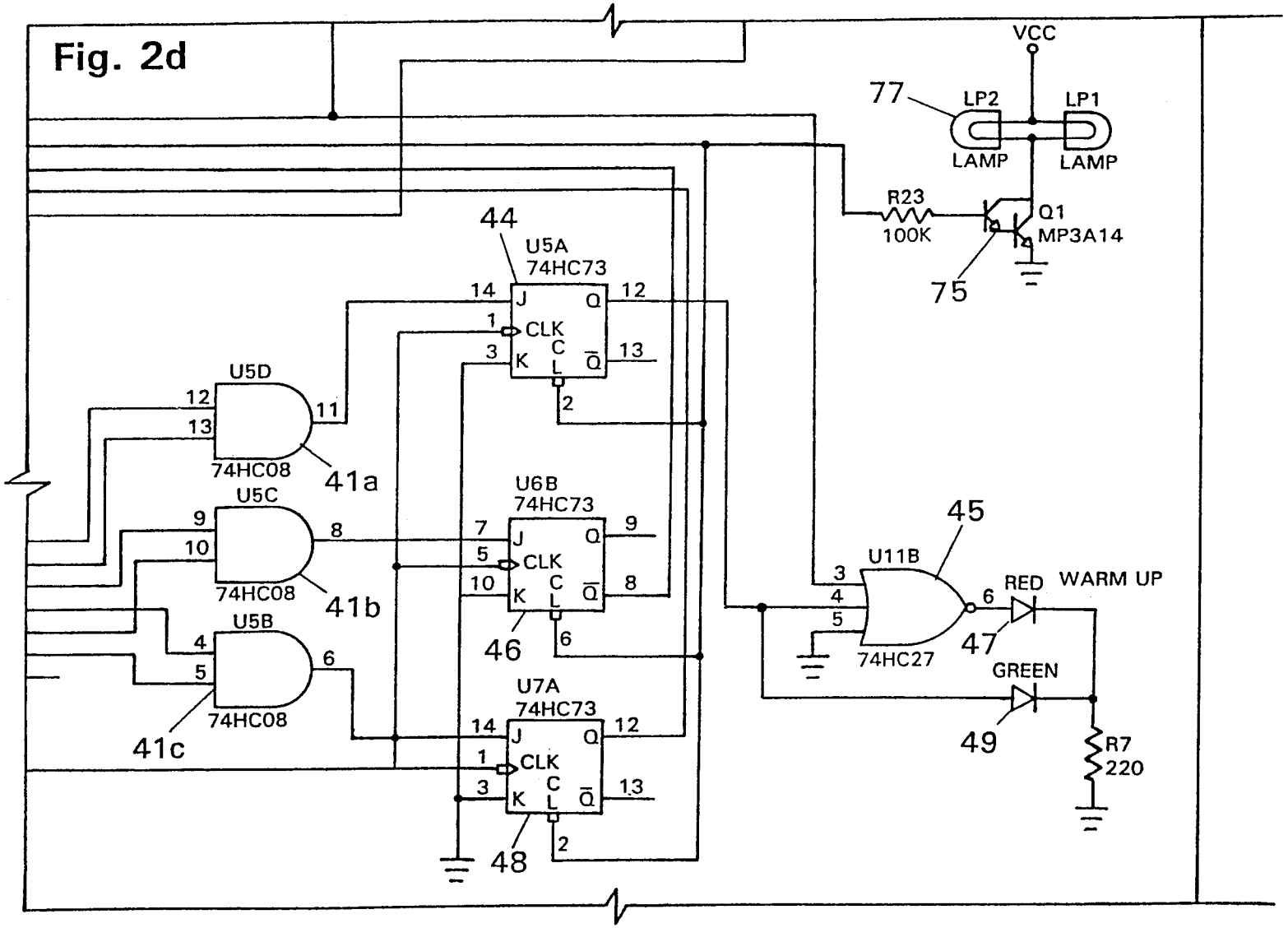
Figure 2E:
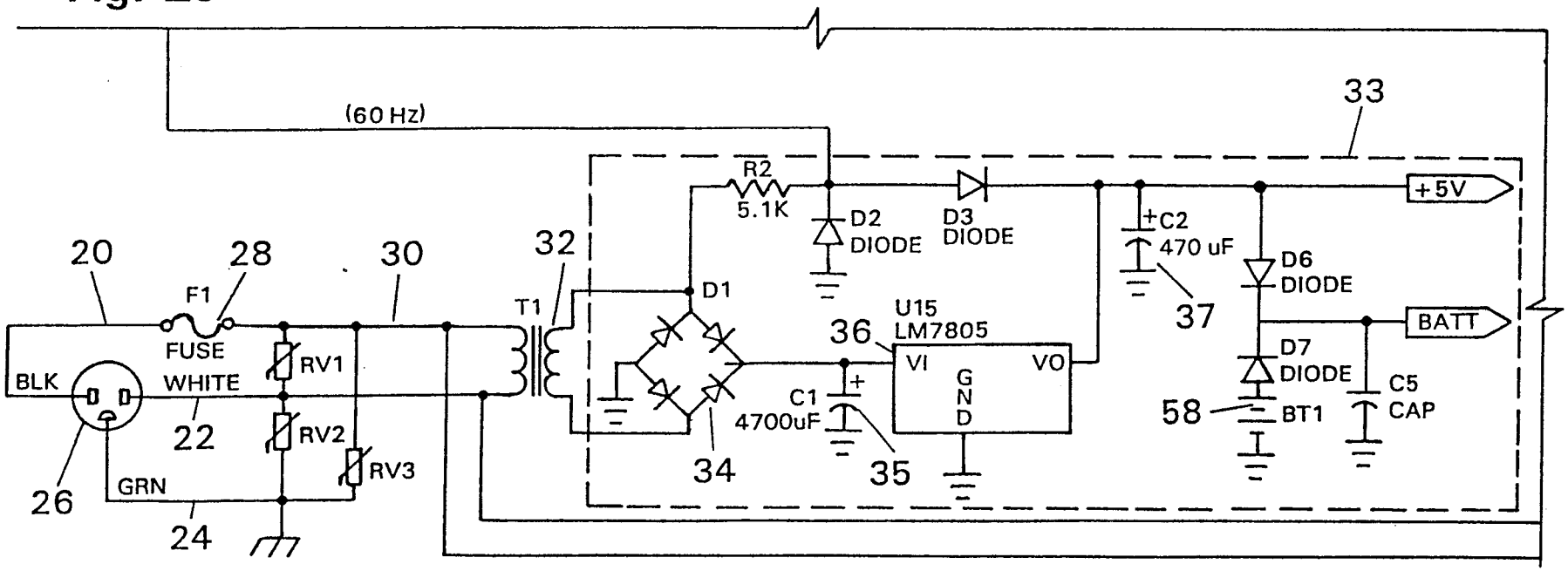
Figure 2F:
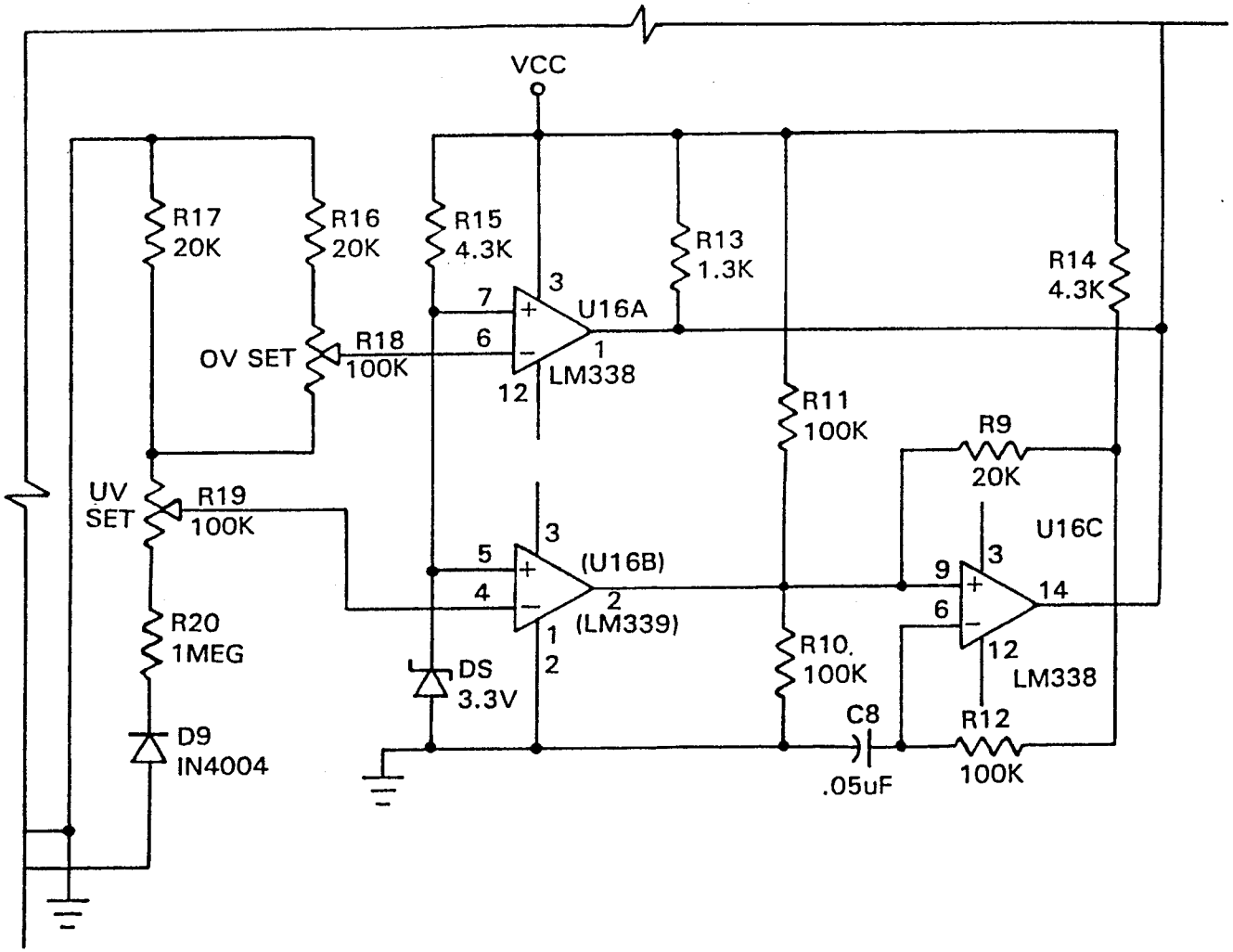

Referring to the drawings, wherein like numerals indicate like elements throughout, there is shown in FIG. 1 a front panel 10 of a service life timer in accordance with the present invention. A display panel 12 is located on the front panel 10 to indicate the amount of time which has elapsed or the expired portion of the expected total service life of a lamp located within a device (not shown). In the preferred embodiment, the lamp is preferably a mercury vapor lamp and the device is preferably a fluorescence microscope. However, it is to be understood by those skilled in the art that the service life of any type of discharge lamp could be measured without departing from the scope and spirit of the present invention. Furthermore, it is to be understood that the discharge lamp could be placed in any type of device such as, but not limited to any type of microscope or spectrophotometer. The display panel 12 in the present embodiment is preferably a liquid crystal display LCD panel. However, it is to be understood by those skilled in the art that the display panel can be any type of display panel, including a light emitting diode LED panel without departing from the scope and spirit of the present invention.

In addition to the display panel 12, a set of three visual indicators 14, 16, and 18 are located on the front panel 10 of the timer. The first visual indicator 14 is preferably multicolor indicator (FIG. 2) which, when illuminated, indicates when the lamp is on and the timer is in use and further, when the lamp is approaching or has reached the end of its expected service life. In the preferred embodiment, the visual indicator 14, turns a first color, in the present embodiment green, to indicate that the timer is functioning, and a second color, in the present embodiment red, to indicate that the lamp is approaching or has reached the end of its service life.

A second visual indicator 16 which is also preferably multicolor indicator (FIG. 2), indicates, when illuminated, when the lamp is in a stand-by position which occurs when the lamp is first turned on or energized and when the lamp is in a ready or warmed-up state. In the preferred embodiment, the second visual indicator 16 turns a first color, in the present embodiment red, when the lamp is in the warm-up stage and turns a second color, in the present embodiment green, when the lamp is in a ready state.

A third visual indicator 18, which is preferably a tri-color LED, indicates, when illuminated, whether the line voltage is within a particular range. In the preferred embodiment, the visual indicator 18 turns a first color, in the present embodiment red, if the line voltage exceeds the desired voltage. The third visual indicator 18 turns a second color, in the present embodiment green, if the line voltage is within a predetermined acceptable range. The third visual indicator 18 turns a third color, in the present embodiment yellow, if the line voltage is below the predetermined acceptable range. In the preferred embodiment, the voltage level should fall between an acceptable range of plus or minus 10% of 115 volts for proper operation.

A reset button 19 is also located on the front panel 10 of the timer for resetting the timer when a new mercury lamp is placed in the device. The reset button 19 causes the LCD display panel 12 to be set to 0.0 and an internal accumulator (FIG. 2) to be reset to 0.0 as will be discussed in detail hereinafter. The reset button 19 may actuate any type of suitable switch such as, but not limited to, a contact switch, a slide switch or a rocker switch without departing from the scope and spirit of the present invention.

Referring to FIG. 2, there is shown a detailed schematic depicting the circuitry of a preferred embodiment of a service life timer in accordance with the present invention. Alternating electric power is supplied from a source (not shown) through lines 20, 22 and 24 to an electrical plug 26. In the preferred embodiment, the source is an AC main or a conventional 110–120 volt, 60 Hz household current supply. However, it is to be understood by those skilled in the art that the timer could be modified to be used with a source in accordance with European or other electrical standards without departing from the scope and spirit of the present invention. A fuse 28 is placed in series with line 20 for preventing a surging current from reaching the timing circuit. A line filter 30 is also inserted across lines 20 and 22 for preventing excess surging of power through the timer circuit while the mercury vapor lamp is initially ignited. A transformer 71 is used to sense a magnetic buildup around the AC main wire feeding the power supply when the switch is turned on and the circuit draws current.

A power supply circuit 33 produces a 5 volt bias voltage from the 6 volt transformer AC voltage. A bridge rectifier 34 converts the incoming AC voltage from the secondary winding of the transformer 32 to a DC voltage of about 6 volts. A smoothing capacitor 35 smooths the DC voltage which is then transmitted to a voltage regulator 36. The voltage regulator 36, which is of a type well-known in the art, maintains the DC output voltage at a predetermined level, in the preferred embodiment 5 volts, by preventing large fluctuations in the voltage. The regulated voltage is smoothed by a second smoothing capacitor 37. The regulated 5 volts DC is used to provide bias voltage to power the CMOS circuitry contained within the timer. The bias voltage is also used to charge a battery 58 which provides auxiliary power to certain portions of the timer circuitry when no power is received from the AC main as will be described in detail hereinafter.

The AC voltage from the secondary winding of the transformer 32 is also transmitted to a chopper circuit 38. In the preferred embodiment, the AC voltage has a frequency of 60 Hz. The chopper circuit 38 removes all of the negative portions from the 60 Hz voltage signal and chops or removes the upper part of the positive portions of the 60 Hz signal to form a series of positive pulses having a rate of 60 pulses per second.

The pulses are received by a first binary counter 40 which receives and counts the pulses in binary form. Each Q output from the binary counter 40 represents a given output count for a particular binary digit. A pair of AND gates 39*a*, 39*b* are associated with certain outputs of the binary counter 40 and are triggered when the appropriate number of pulses are counted by the binary counter 40. In the preferred embodiment, the first AND gate 39*a* is enabled when 10,752 pulses are received by the binary counter 40 and the second AND gate 39*b* is enabled when 10,800 pulses are received by the binary counter 40. When the second AND gate 39*b* is enabled, a three-minute time segment has elapsed since the time when the binary counter 40 began to count the pulses. The enabled second AND gate 39*b* transmits a signal which triggers the clock of a second binary counter 42 to increment the second counter 42 by one every three minutes. The second AND gate 39*b* also causes the first binary counter 40 to be reset at the end of each three minute count.

The second AND gate 39*b* also transmits three minute pulses to a six minute flip-flop 51. The six minute flip-flop 51 is activated to provide an output pulse each time it receives two three minute pulses from AND gate 39*b*. The six minute flip-flop 51 is associated with an integrated circuit 43.

The integrated circuit 43 is a gate circuit which comprises both a six minute gate and a three minute gate which are both connected by a NOR gate. In the preferred embodiment, both the six minute gate and the three minute gate are three input AND gates. The six minute pulse from the six minute flip-flop 51 is received by the six minute gate. The second AND gate 39*b* transmits the three minute pulses to two of the inputs of the three minute gate. In the preferred embodiment, the third input of the three minute gate is defaulted to be positive and is enabled so that the three minute gate transmits three minute pulses unless it receives a negative input as will be described in detail hereinafter.

Each three minute pulse received by the integrated circuit 43 and passed through the three minute AND gate is transmitted to a totalizer circuit 50. The totalizer circuit 50 is associated with an LCD display 52 which displays the total lamp service life usage value which has expired. In the preferred embodiment, the LCD display 52 displays the expired lamp life value in tenths of an hour. Each time the totalizer circuit 50 receives a pulse from the integrated circuit 43, the first digit of the LCD display 52 is incremented by 1. Therefore, during operation of the timer in a first mode, each time the totalizer circuit 50 receives a three minute pulse, the LCD display is increased by a tenth of an hour (signifying the expiration of six minutes of lamp life) when in reality only three minutes of time has actually elapsed.

In addition, a six minute pulse is transmitted to a tenth of an hour counter 53 associated with an accumulator 54 for each three minute pulse received by the integrated circuit 43 which causes the tenth of an hour counter 53 to be incremented by six minutes or a tenth of an hour for each three minute time segment which has actually elapsed. When the tenth of an hour counter 53 receives ten six minute pulses, a pulse is transmitted to the accumulator 54 which is preferably an hour counter. Therefore, the tenth of an hour counter 53 and the accumulator 54 also records twice as much time as has actually elapsed.

The second binary counter 42 receives a clock pulse each time a three minute pulse is generated from the second AND gate 39*b*. The second binary counter 42 is associated with three AND gates 41*a*, 41*b*. 41*c* which in turn are each associated with one of a set of three flip-flops 44, 46 and 48. The first AND gate 41*a* is enabled when both the Q1 and Q2 outputs of the second binary counter 42 are activated which occurs after nine minutes of time have elapsed or when three three minute pulses are received by the second binary counter 42. The first AND gate 41*a* triggers flip-flop 44 which transmits a signal to a warm-up circuit 56.

When the timer is initially turned on, a NOR gate 45 located within the warm-up circuit 56 is enabled which causes a first LED 47 to be illuminated indicating that the mercury lamp has not yet warmed up. In the preferred embodiment, the first LED 47, which functions as the second visual indicator 16, is a red LED. When the flip-flop 44 is activated, i.e., nine minutes after the lamp is energized, a positive Q output pulse is transmitted from the flip-flop 44 to the NOR gate 45 which disables the NOR gate 45 thereby preventing the first LED 47 from illuminating and causing a second LED 49 to illuminate. In a preferred embodiment, the second LED 49, which also functions as the second visual indicator 16, is preferably a green LED which indicates that the mercury vapor lamp has completed its warm-up period and is in a ready state.

A second AND gate 41*b* is enabled by the second binary counter 42 when the counter 42 has received 20 three minute pulses, i.e., one hour after the lamp is initially energized. An output pulse from AND gate 416 is transmitted to the second flip-flop 46 which sends a negative Q pulse to the integrated circuit 43. The negative Q pulse from the second flip-flop 46 disables the three minute AND gate within the integrated circuit 43 and causes the integrated circuit 43 to discontinue sending the three minute pulses to the totalizer circuit 50 and the accumulator 54. Since the six minute gate within the integrated circuit 43 is also disabled, no input pulses are received by the totalizer circuit 50, the tenth of an hour counter 53 or the accumulator 54 so their respective time totals are not incremented after the lamp has been energized for one hour.

A third AND gate 41*c* is enabled when the second binary counter 42 has received 40 three minute pulses. When the third AND gate 41*c* is enabled, i.e., after 120 minutes have lapsed since the lamp was energized, the third flip-flop 48 is activated to transmit a positive Q pulse to the integrated circuit 43. The positive Q pulse from the third flip-flop 48 causes the six minute gate in the integrated circuit 43 to be enabled. From that point on, each time the integrated circuit 43 receives a pulse from the six minute flip-flop 51, a signal is transmitted to the totalizer circuit 50 and the tenth of an hour counter 53 to increase the total service life usage value by one-tenth of an hour. As long as the six minute gate in the integrated circuit 43 is enabled, six minutes of time are recorded for each six minutes of time which has actually elapsed. Therefore, for each six minute interval of time which has elapsed, the tenth of an hour counter 53 and totalizer circuit 50 are incremented by a tenth of an hour or six minutes. As discussed above, when the tenth of an hour counter 53 received ten six minute pulses, a pulse is transmitted to the accumulator 54 which count in hour units.

Because the lamp service life does not expire linearly with time, a non-linear approach must be taken to determine the lamp usage value for each time period the lamp is energized. The lamp usage value for each time period the lamp is energized is determined by assigning a first time dependent value for each time unit of a first predetermined time segment of the time period that the lamp is energized. In the preferred embodiment, the timer via the totalizer circuit 50 and the tenth of an hour counter 53 records a tenth of an hour of expired lamp service life for each three minute time period which actually elapses for the first hour the lamp is energized. Therefore, the totalizer circuit 50 and tenth of an hour countereach record twice the amount of time which actually elapses for the first hour. In addition, the accumulator 54 also records twice the amount of time which actually elapses for the first hour via the tenth of an hour counter 53.

A second time dependent value is assigned for each time segment of a second predetermined time segment after expiration of the first time segment that the lamp is energized. In the preferred embodiment, no time is recorded by either the totalizer circuit 50 the tenth of an hour counter 53 or the accumulator 54 during the second hour the lamp is energized reflecting that no service life of the lamp has expired for the second hour of lamp use.

A third time dependent value is assigned for each time unit of the time period that the lamp is energized beyond the expiration of the second time segment. In the preferred embodiment, the totalizer circuit 50 and the tenth of an hour counter 53 each record a tenth of an hour of lamp life expiration for each tenth of an hour which actually elapses, i.e., time is recorded linearly. Once the tenth of an hour counter 53 receives ten six minute pulses, a pulse is transmitted to the accumulator 54 which counts in one hour units. The time is recorded linearly after the second hour the lamp is energized until the lamp is no longer energized. If the lamp is no longer energized and then re-energized at a later time, the time recording process repeats itself. It is to be understood by those skilled in the art that the timing process does not have to extend beyond two hours but can be any suitable time period, and further the timing process is restarted regardless of when the lamp is no longer energized.

The total lamp service life usage value is determined by combining the lamp usage value for the first, second and third time dependent values recorded each time the lamp is energized. The total lamp service life usage value is maintained in the totalizer circuit 50 and accumulator 54 irrespective of whether the lamp is energized.

The accumulator 54 determines when the lamp service life usage value of the mercury vapor lamp is approaching its expected expiration value. A tenth of an hour counter 53 is associated with the accumulator 54 which transmits a pulse to the accumulator 54 after an hour of elapsed time has been received (either ten three minute pulses or ten six minute pulses) from the integrated circuit 43. In the preferred embodiment, the accumulator 54 activates a first visual indicator 14 when the accumulated hour count reaches 192 hours for a mercury vapor lamp having a 200 hour service life and 96 hours for a mercury vapor lamp having a service life of 100 hours. A switch 57 is associated with the accumulator 54 for identifying the type of mercury vapor lamp, either a 100 or a 200 hour lamp, contained within the device.

If the lamp is a 100 hour lamp, the switch 57 is placed in a first position which connects the Q8 output of the accumulator to a NOR gate 61. An AND gate 59 is enabled when the accumulator 54 receives 96 pulses from the tenth of an hour counter 53 thereby triggering the Q6 and Q7 outputs of the accumulator 54 and transmitting a signal to the AND gate 59 which represents 96 hours. The AND gate 59 is connected to one input of the NOR gate 61.

If the lamp is a 200 hour lamp, the switch 57 is placed in a second position which connects the Q7 and Q8 outputs of the accumulator 54 to the AND gate 59, and disconnects the Q8 output of the accumulator 54 from the NOR gate 61 causing the AND gate to be enabled when the accumulator 54 receives 192 pulses from the tenth of an hour counter 53 thereby triggering the Q7 and Q8 outputs of the accumulator 54 and transmitting a signal to the AND gate 59 which represents 192 hours.

Irrespective of the position of switch 57, when the AND gate 59 is not enabled, the NOR gate 61 transmits a signal to a second NOR gate 63 which is also enabled and causes a first LED 65 to illuminate. In the preferred embodiment, the first LED is a green LED which indicates that the mercury vapor lamp has not approached its expiration value.

When the AND gate 59 is enabled, the NOR gate 61 transmits a signal to NOR gate 63 causing the NOR gate 63 to be disabled and to discontinue illuminating the first LED 65. At the same time, the NOR gate 61 transmits a signal to a second LED 67 causing it to illuminate. In the preferred embodiment, the second LED 67 is a red LED which indicates that the lamp should be replaced.

The timer is also electrically connected to an alarm or buzzer circuit 60 which activates an audible alarm 62 at critical events which occur during the operation of the timing ciruit. The critical events occur when the line voltage either exceeds or falls below a predetermined value, and when it is time to replace the lamp, i.e., when the total lamp service life usage value approaches its expected expiration value.

The AC main voltage is monitored by a voltage monitor circuit 64. The AC main voltage is converted to a stepped down DC voltage which is a lower voltage and proportional to the AC main voltage, prior to entering the voltage monitor circuit 64. The generated DC voltage is received by a pair of potentiometers 68*a*, 68*b*, which are respectively connected to a pair of comparators 70, 72. The first comparator 70 is a high voltage comparator which determines if the incoming DC voltage is above a predetermined level. The second comparator 72 is a low voltage comparator which determines if the incoming DC voltage is below a predetermined level. A zener diode 66 monitors a baseline input which is received by both of the comparators 70, 72 for establishing the predetermined thresholds.

If the incoming DC voltage exceeds the predetermined threshold voltage, the high comparator 70 triggers a first transistor 76 which passes a current through the third LED 18 in a first direction causing the LED 18 to illuminate and display a red color indicating that the input voltage is too high. At the same time, the high voltage comparator 70 triggers the alarm circuit 60 to activate the alarm 62.

If the incoming DC voltage is within the designated range, neither the high comparator 70 nor the low comparator 72 are triggered which grounds the base of the first transistor 76. The 5 volt bias voltage is applied to a second transistor 78 causing current to pass through the third LED 18 in a direction opposite to that of the first transistor 76. The second transistor 78 causes the third LED 18 to illuminate and display a green color indicating that the voltage level is within an acceptable range.

If the incoming DC voltage is below the predetermined threshold voltage, the low comparator 72 is activated and, through operational amplifiers 74 and 73, transmits an AC voltage to the first transistor 76. The operational amplifiers 73, 74 cause the voltage to alternately turn on and off at a rapid rate. This in turn causes the first and second transistors 76, 78 to alternately switch on and off at a rapid rate. As a result, the third LED 18 appears to a viewer to display a yellow color which indicates that the line voltage being received is too low. At the same time, the low comparator 72 activates the alarm circuit 60 which triggers the alarm 62.

Once the lamp has been turned off or is no longer electrically energized, power is also disabled to the timer. A current sensor 71 associated with the timer senses when power is received from the AC main. The current sensor 71 powers an enable line 73 which is connected to a transistor switch 75. When the transistor switch 75 is activated, a pair of lamps 77 light up the sides of the display panel 52. When power is no longer sensed by the current sensor 71, a capacitor 79 associated with the current sensor having a two second discharge time, delays the loss of power to the timer. The loss of power causes the enable line 73 to go low and triggers a reset in the second binary counter 42. The enable line 73 also resets the warm up circuit 56, the three flip-flops 42, 44, 46 and the six minute flip-flop 51.

The battery 58 is connected to the tenth of an hour counter 53, the accumulator 54 and the totalizer circuit 50 and maintains the accumulated lamp service life usage value of the accumulator 54 and the totalizer circuit 50 when the AC main power is off. The battery 58 is charged by the power supply circuit 33 when power is received from the electrical source.

Figure 3A:
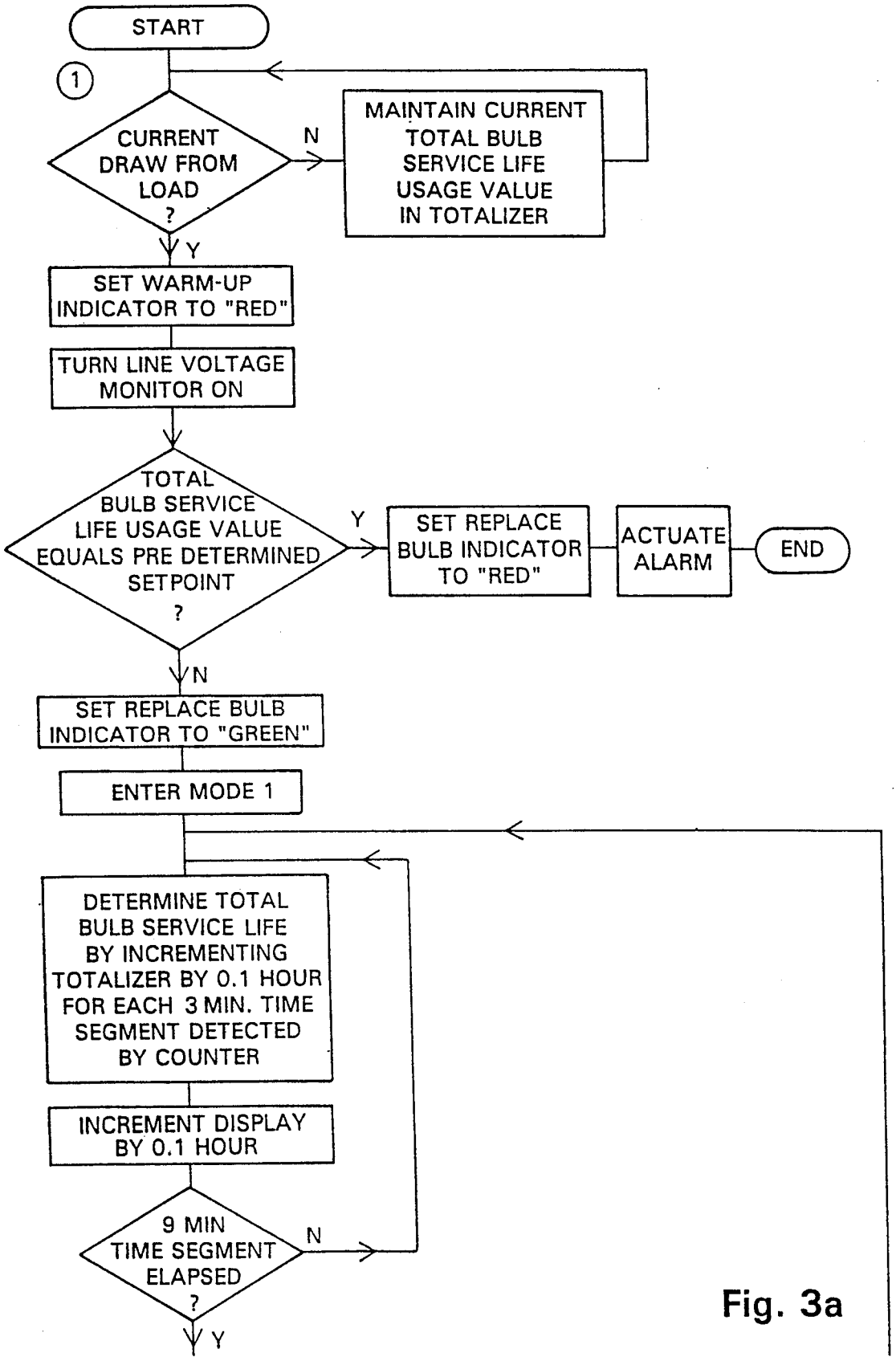
FIGS. 3*a*–3*c* are flow charts depicting the recordation of time according to the service life timer of FIG. 1.
Figure 3B:
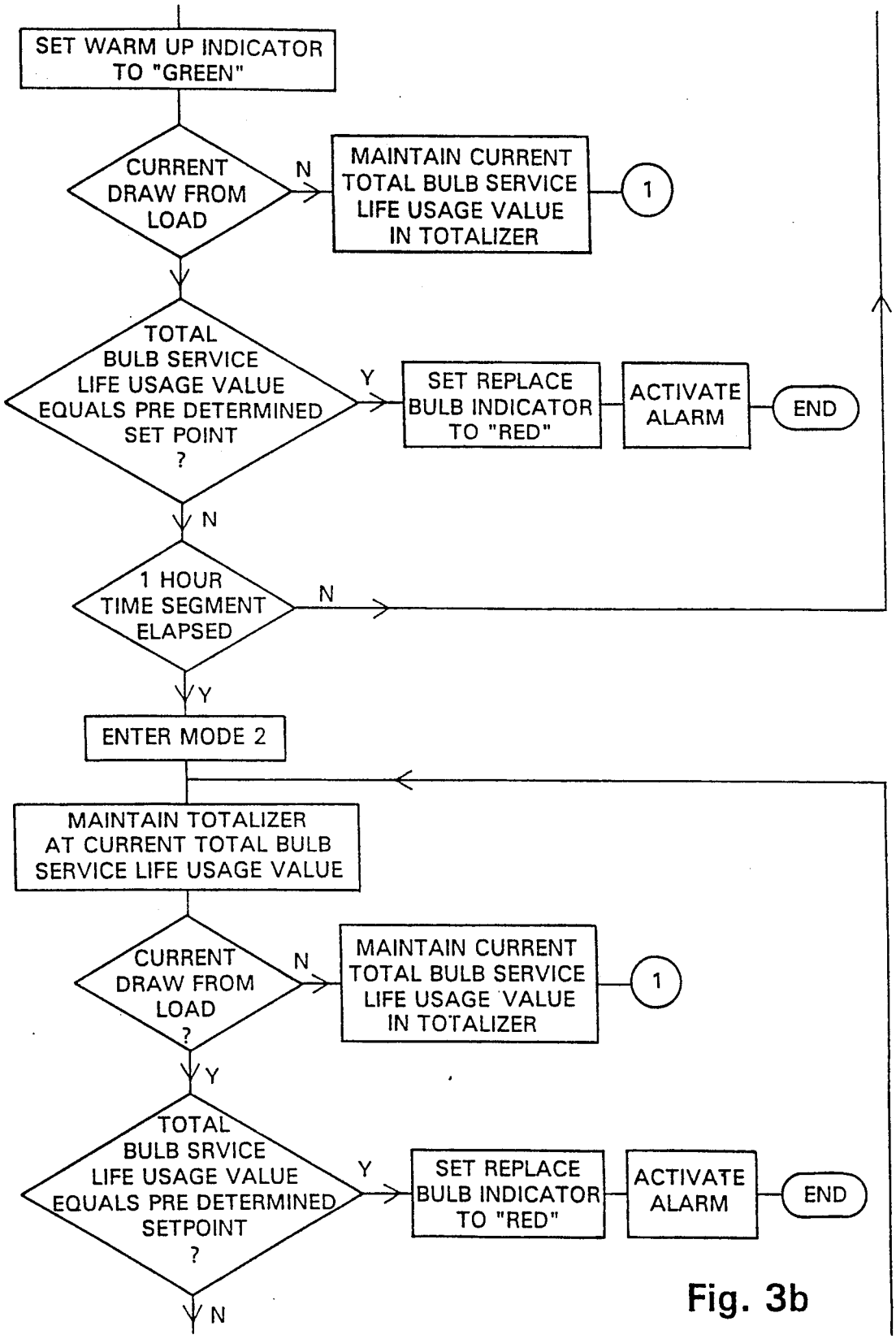
Figure 3C:
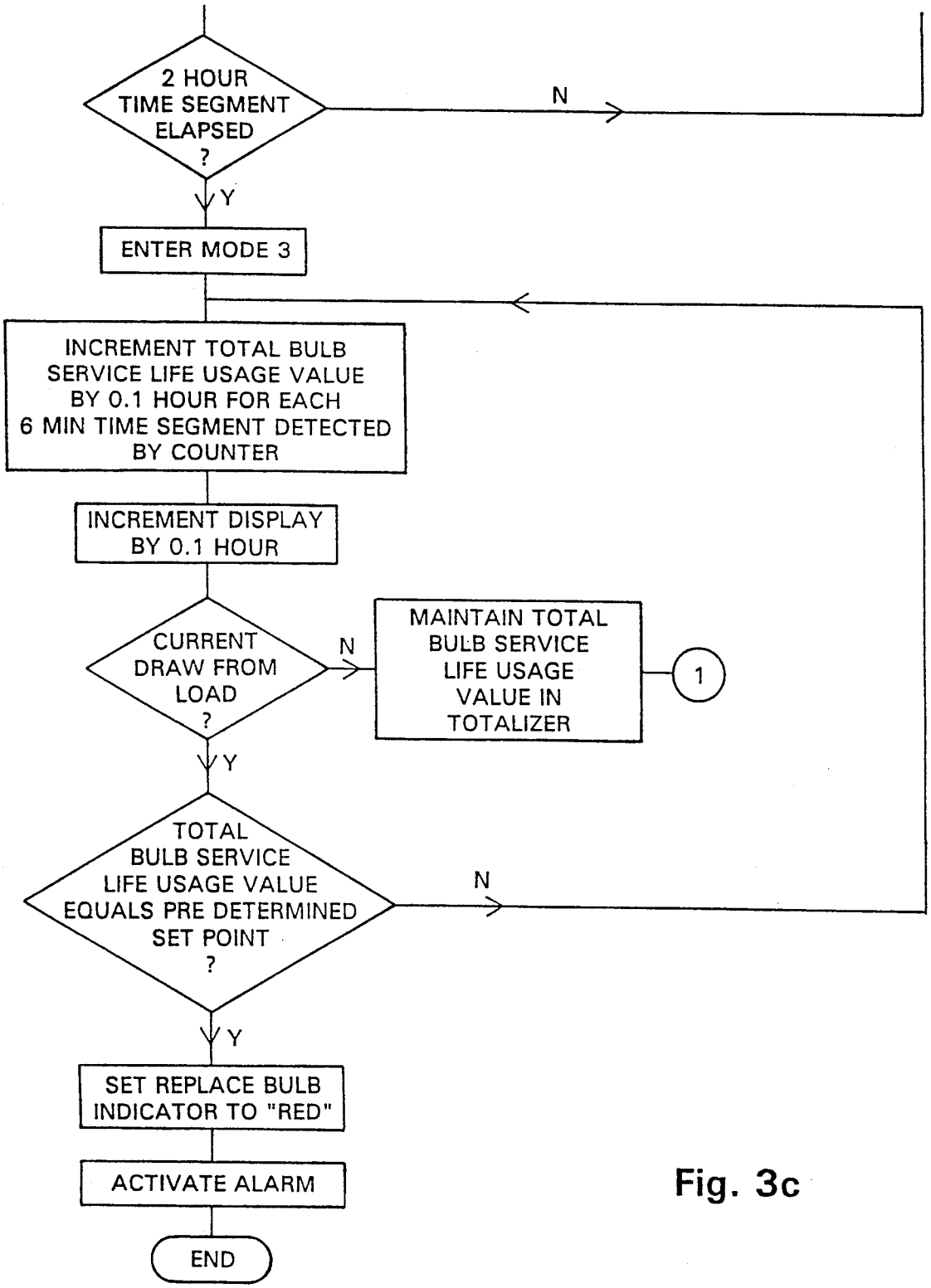

Referring to FIGS. 3*a*–3*c*, there is shown a functional flow chart depicting the operation of the service life timer in accordance with the present invention. In the preferred embodiment, the timer is connected in series between an electrical source and the device containing the mercury vapor lamp. In block 80, it is determined whether a current is being drawn by the electrical load, i.e., is the lamp electrically energized. If current is not being drawn by the electrical load indicating the lamp is off, the total lamp service life usage value stored within the accumulator is maintained at its current level in block 82. If the device has never been turned on, i.e., has never drawn current, the value stored within the accumulator is zero. Once a current draw is detected indicating the lamp has been electrically energized (i.e., is on), a warm-up indicator, LED 16 located on the front panel 10 of the timer is illuminated red at block 84. In addition, a line voltage monitor circuit 64 is turned on at block 86.

Next, it is determined whether the total lamp service life usage value stored in the accumulator equals a predetermined set point at block 88. In the preferred embodiment, the predetermined set point is the expected expiration value of the service life of the mercury lamp, i.e., the expected lamp life and is either 96 hours or 192 hours depending upon the life of the lamp being used. If the total lamp service life usage value stored within the accumulator 54 is greater than or equal to the predetermined set point, the replace lamp indicator LED 14 located on the front panel 10 of the timer is illuminated red at block 90. At the same time, an audio alarm 62 is activated at block 92 to provide an additional warning to the user. Once the replaced lamp indicator 14 has been illuminated, i.e., turns red, the user has a limited amount of time (grace period) to replace the lamp prior to its expected failure.

If the total lamp service life usage value is less than the predetermined set point, the replace lamp indicator 14 is set to green at block 94 indicating the lamp service life is within acceptable limits. At this point, the timer enters mode 1 at block 96. The total lamp service life is determined by incrementing the totalizer circuit 50 by a tenth of an hour for each three minute time segment detected by counter 40 in block 98. Each time a three minute time segment is detected and the is incremented, the display unit 52 is also incremented by a tenth of an hour at block 100.

A determination is made as to whether an initial nine minute time segment has elapsed in block 102. The nine minute time segment signifies that the mercury lamp has been adequately warmed up and is ready for use. If the nine minute time segment has not elapsed, the circuit returns to block 98 to determine whether the next three minute time segment has been reached by counter 40. If the initial nine minute time segment has elapsed, the warm-up indicator 16 is illuminated green in block 104.

Next, it is determined whether a current is still being drawn by the electrical load at block 106. If current is not being drawn by the electrical load, the total lamp service life usage value currently stored in the totalizer circuit 50 is retained in memory in block 108. At the same time as current is no longer being drawn by the electrical load, a battery 58 associated with the totalizer circuit 50 maintains the total lamp service life usage value in the totalizer circuit 50. The timer is then essentially maintained in a standby state at block 80 until a current is again drawn by the electrical load and the foregoing procedure is repeated.

If current continues to be drawn by the electrical load, it is next determined if the total lamp service life usage value equals a predetermined set point in block 110. As discussed above, if the total lamp service life usage value equals or exceeds the predetermined set point then the replace lamp indicator 14 is illuminated red in block 112 and an alarm is activated in block 114. If the total lamp service life usage value is less than the predetermined set point, it is next determined whether a one hour time segment has elapsed in block 112. If the one hour time segment has not elapsed, the total lamp service life is continued to be determined by incrementing the totalizer 50 by a tenth of an hour for each three minute time segment detected by the counter 40 in block 98.

If the one hour time segment has elapsed, the timer enters mode 2 at block 114. The totalizer 50 is maintained at the current total lamp service life usage value in block 116. It is next determined if current continues to be drawn by the electrical load at 118. If current is not being drawn by the load, the existing total lamp service life usage value is stored in the totalizer 50 and is maintained by power provided by the battery 58. The timer remains in standby until current is again drawn by the load at block 80 and the above-described procedure is repeated. If current continues to be drawn by the load, it is next determined if the total lamp service life usage value equals or exceeds the predetermined set point in block 120 and, if so, the replace lamp indicator 14 is illuminated red and the alarm is activated. If the total lamp service life usage value is less than the predetermined set point, it is next determined if the two hour time segment has elapsed in block 126. If the two hour time segment has not elapsed, the beginning of mode 2 is reentered at block 116 and the total lamp service life usage value is continued to be maintained at its present value.

If the two hour time segment has elapsed, the timer enters mode 3 at block 128. While operating in mode 3, the total lamp service life usage value is incremented by a tenth of an hour for each six minute time segment at block 130. At the same time that a six minute time segment is detected, the totalizer 50 and the display unit 52 are incremented by a tenth of an hour at block 132. At block 134, it is detected whether a current continues to be drawn by the load. If the current continues to be drawn by the load, it is next determined whether the total lamp service life usage value equals or exceeds the predetermined set point at block 138. If the total lamp service life usage value is less than the predetermined set point, the timer returns to the beginning of mode 3 at block 130. If the total lamp service life usage value equals or exceeds the predetermined set point, the replace lamp indicator 14 is illuminated red at block 140 and the alarm is activated at 142. Once the mercury vapor lamp approaches its expected expiration value, the user is expected to replace the mercury vapor lamp within a reasonable amount of time.

From the foregoing description, it can be seen that the present invention comprises an apparatus for estimating the expired portion of the expected total service life of a mercury vapor lamp based upon the time that the lamp is electrically energized. It will be appreciated by those skilled in the art that changes could be made to the embodiment described above without departing from the broad inventive concept thereof. It is understood, therefore, that this invention is not limited to the particular embodiment disclosed, but is intended to cover all modifications which are within the scope and spirit of the invention as defined by the appended claims.

I claim:

1. An apparatus for estimating the expired portion of the expected total service life of a mercury vapor lamp based upon the time that the lamp is electrically energized comprising:

means for measuring the length of time that the lamp is energized for each time period that the lamp is energized throughout the life of the lamp;

means for determining a lamp usage value for each said time period that the lamp is energized, the lamp usage value for each said time period being determined by assigning a first time dependent value of each time unit of a first predetermined time segment of the time period that the lamp is energized, assigning a second time dependent value for each time unit of a second predetermined time segment of the time period commencing after expiration of the first time segment that the lamp is energized and assigning a third time dependent value for each time unit of the time period that the lamp is energized beyond the expiration of the second time segment, the first, second and third time dependent values being combined to form the lamp usage value for said time period;

means for accumulating the lamp usage values for all said time periods the lamp is energized to provide a current running total of the lamp service life usage value; and means for displaying the total lamp service life usage value as an indication of the expired life of the lamp.

2. The apparatus according to claim 1, wherein said first predetermined time segment is an hour.

3. The apparatus according to claim 1, wherein the second predetermined time segment is an hour.

4. The apparatus according to claim 1, wherein said time unit is a tenth of an hour.

5. The apparatus according to claim 1, wherein said displaying means is an LCD display.

6. The apparatus according to claim 1, wherein the displaying means displays the total lamp service life usage value in tenths of an hour.

7. The apparatus according to claim 1, wherein said first time dependent value is twice the value of the time unit.

8. The apparatus according to claim 1, wherein said second time dependent value is zero.

9. The apparatus according to claim 1, wherein said third time dependent value is equal to the value of the time unit.

10. The apparatus according to claim 1, further comprising first LED means for displaying when the lamp is in a warm-up state.

11. The apparatus according to claim 10, further comprising second LED means for identifying when the electrical energy transmitted to the timer is at a predetermined level.

12. The apparatus according to claim 11, further comprising third LED means for indicating when the total service life of the mercury vapor lamp is near expiration.

13. The apparatus according to claim 1, further comprising alarm means for activating an audible alarm when a predetermined percentage of the expected service life of the mercury lamp has expired.

14. The apparatus according to claim 1, wherein the mercury vapor lamp is contained within a fluorescence microscope.

15. A method for estimating the expired portion of the expected total service life of a mercury vapor lamp based upon the time that the lamp is electrically energized, the method comprising the steps of:

measuring the length of time that the lamp is energized for each time period that the lamp is energized through the life of the lamp;

determining a lamp usage value for each said time period that the lamp is energized by assigning a first time dependent value for each time unit of a first predetermined time segment of the time period that the lamp is energized;

assigning a second time dependent value for each time unit of a second predetermined time segment of the time period commencing after the expiration of the first time segment that the lamp is energized;

assigning a third time dependent value for each time unit of the time period that the lamp is energized beyond the expiration of the second time segment;

combining the first, second and third time dependent values to form the lamp usage value for said time period;

accumulating the lamp usage values for all said time periods the lamp is energized to provide a total of the lamp life usage value; and displaying the total lamp service life usage value as an indication of the expired service life of the lamp.

16. The method according to claim 15, wherein said first predetermined time segment is an hour.

17. The method according to claim 15, wherein the second predetermined time segment is an hour.

18. The method according to claim 15, wherein said time unit is a tenth of an hour.

19. The method according to claim 15, further comprising the step of displaying the total lamp service life usage value in tenths of an hour.

20. The method according to claim 15, wherein said first time dependent value is twice the value of the time unit.

21. The method according to claim 15, wherein said second time dependent value is zero.

22. The method according to claim 15, wherein said third time dependent value is equal to the value of the time unit.

23. The method according to claim 15, further comprising the step of providing a first LED for displaying when the lamp is in a warm-up state.

24. The method according to claim 23, further comprising providing a second LED for identifying when the electrical energy transmitted to the timer is in a predetermined level.

25. The method according to claim 24, further comprising the step of providing a third LED for indicating when the total service life of the mercury vapor lamp is near expiration.

26. The method according to claim 15, further comprising the step of providing an alarm which is activated when a predetermined percentage of the expected service life of the mercury lamp has expired.

* * * * *